US011344056B2

(12) United States Patent
Belfance et al.

(10) Patent No.: US 11,344,056 B2
(45) Date of Patent: May 31, 2022

(54) METHODS FOR STORING AND PRESERVING CANNABIS OR CANNABIS-CONTAINING SUBSTANCES

(71) Applicant: CSP Technologies, Inc., Auburn, AL (US)

(72) Inventors: John Belfance, Phenix, AL (US); Kasey Myers, Auburn, AL (US); Ethan Ross Perdue, Auburn, AL (US); William Frederick Spano, Auburn, AL (US); Jonathan Freedman, Auburn, AL (US); Franklin Lee Lucas, Jr., Opelika, AL (US)

(73) Assignee: CSP Technologies, Inc., Auburn, AL (US)

( * ) Notice: Subject to any disclaimer, the term of this patent is extended or adjusted under 35 U.S.C. 154(b) by 656 days.

(21) Appl. No.: 15/331,837

(22) Filed: Oct. 22, 2016

(65) Prior Publication Data

US 2017/0112181 A1 Apr. 27, 2017

Related U.S. Application Data

(60) Provisional application No. 62/245,536, filed on Oct. 23, 2015.

(51) Int. Cl.
*A24B 9/00* (2006.01)
*B65B 5/04* (2006.01)
(Continued)

(52) U.S. Cl.
CPC ..... *A24B 9/00* (2013.01); *A24F 25/00* (2013.01); *B65B 5/04* (2013.01); *B65D 51/24* (2013.01); *B65D 51/28* (2013.01); *B65D 81/22* (2013.01)

(58) Field of Classification Search
None
See application file for complete search history.

(56) References Cited

U.S. PATENT DOCUMENTS 4,934,524 A * 6/1990 St. Charles ..... A24F 25/02 206/204
5,936,178 A * 8/1999 Saari ..... A24F 25/02 84/453

(Continued)

FOREIGN PATENT DOCUMENTS

WO WO-2014195250 A1 * 12/2014 ..... A24B 13/00

OTHER PUBLICATIONS

Gary Korb, How to set-up your humidor, Feb. 11, 2010; https://youtu.be/PnZukYgXUKw (Year: 2010) (Year: 2010).*

(Continued)

*Primary Examiner* — Chinyere J Rushing-Tucker
(74) *Attorney, Agent, or Firm* — Carol A. Marmo; Eckert Seamans Cherin & Mellott, LLC

(57) ABSTRACT

Methods for storing and preserving cannabis or cannabis-containing substances using container assemblies are disclosed. An exemplary container assembly includes a lid and a container body. The lid is configured to be closed onto the container body over an opening of the container body. The opening provides access to an interior space having a product compartment configured to store product. The assembly also includes a humectant compartment permanently secured within the assembly. The humectant compartment includes a rigid housing containing a humectant solution. The rigid housing is configured within the assembly to prevent leaking of the humectant solution into the product compartment while facilitating bidirectional transmission of moisture between the humectant compartment and the product compartment. The humectant solution regu- (Continued)

lates relative humidity of the product compartment to maintain the relative humidity at a predetermined level.

20 Claims, 11 Drawing Sheets

(51) Int. Cl.

| | |
|---|---|
| ***B65D 81/22*** | (2006.01) |
| ***B65D 51/28*** | (2006.01) |
| ***A24F 25/00*** | (2006.01) |
| ***B65D 51/24*** | (2006.01) |

(56) References Cited

U.S. PATENT DOCUMENTS

| | | | | |
|---|---|---|---|---|
| 6,398,067 | B1 * | 6/2002 | Belfance | B65D 43/162 215/235 |
| 6,921,026 | B2 * | 7/2005 | Saari | A23L 3/3418 239/53 |
| 8,342,185 | B2 * | 1/2013 | Egued | A24F 13/24 206/213.1 |
| 2005/0016873 | A1 * | 1/2005 | Belfance | B65D 43/162 206/204 |
| 2012/0031779 | A1 * | 2/2012 | Egued | A24F 25/02 206/204 |
| 2013/0220845 | A1 * | 8/2013 | Smith | A24F 25/02 206/213.1 |
| 2014/0061073 | A1 * | 3/2014 | Haidar | A24F 23/00 206/256 |
| 2014/0216956 | A1 * | 8/2014 | Ott | A24F 25/02 206/213.1 |
| 2015/0136618 | A1 * | 5/2015 | Patel | B65D 81/22 206/0.5 |
| 2016/0107796 | A1 * | 4/2016 | Sibley | B65B 29/00 206/213.1 |
| 2016/0114963 | A1 * | 4/2016 | Reed | B65B 1/00 220/23.2 |
| 2016/0122047 | A1 * | 5/2016 | Fulcher | A24B 13/00 53/412 |
| 2016/0304264 | A1 * | 10/2016 | Steinberg | B65D 45/025 |
| 2017/0072056 | A1 * | 3/2017 | Egberg | A61K 47/22 |
| 2017/0137201 | A1 * | 5/2017 | Jackson | A24F 23/00 |
| 2018/0148237 | A1 * | 5/2018 | Sibley | B65B 29/00 |

OTHER PUBLICATIONS

CheapHumidors.com, Three Cigar Leather Aluminum Tube, Oct. 10, 2012; https://youtu.be/G-FwLkQSRLo?t=30 (Year: 2012) (Year: 2012).*

Custom Edge Works, Visol "Little Joe" Travel Cigar Humidor Case, Nov. 20, 2014; https://youtu.be/H2HBza-nuno?t=272 (Year: 2014) (Year: 2014).*

JR Cigars, How-to: Setting up a Humidor With the #CIGARchitect, Dec. 1, 2014; https://youtu.be/se9tXOhleDQ?t=179 (Year: 2014) (Year: 2014).*

Boveda, Basics of Boveda for Medical Cannabis, Mar. 20, 2013; https://youtu.be/FdwY8-FPXqE?t=130 (Year: 2013) (Year: 2013).*

Growers House, Unboxing Review: CVault Curing Storage Container/ Boveda 2 Way Humidity Control, May 17, 2014, https://youtu.be/rkhVZQezKao?t=62 (Year: 2014) (Year: 2014).*

Cannador®, Premium Weed Storage| Cannador®, Mar. 13, 2014; https://youtu.be/UP-k3bda8mk (Year: 2014) (Year: 2014).*

Canaseur, Cannaseur®, Feb. 25, 2016; https://youtu.be/rLqO6Om2ARo (Year: 2016) (Year: 2016).*

Tvape, RYOT Humidor Box Review, Oct. 4, 2012; https://youtu.be/Q27J5mQIZUM (Year: 2012) (Year: 2012).*

Will Smith, Cannabis Marijuana Humidor, May 15, 2011; https://youtu.be/nzO5BuVcm0U (Year: 2011) (Year: 2011).*

CheapHumidors.com, How to Charge a Humidor Humidifier, Apr. 16, 2014; https://youtu.be/U3KmA0OFE2s (Year: 2014) (Year: 2014).*

* cited by examiner

METHODS FOR STORING AND PRESERVING CANNABIS OR CANNABIS-CONTAINING SUBSTANCES

BACKGROUND OF THE INVENTION

1. Field of Invention

This invention relates generally to packaging for products requiring a humidity-controlled environment. More particularly, the invention relates to various embodiments of a tamper evident container, e.g., vial, having a humectant-containing compartment and another compartment configured for containing humidity-sensitive product, wherein humectant in the humectant-containing compartment regulates humidity in the product compartment. The container is optionally used to store and preserve cannabis or a cannabis-containing substance.

2. Description of Related Art

Cannabis, a.k.a., marijuana, is listed as a Schedule 1 substance under the Controlled Substances Act of 1970. The U.S. federal government thus officially regards cannabis as having high potential for abuse and no established medical use. However, various states and localities have passed laws allowing use of cannabis for medical purposes and some even for recreational use. In states or localities where cannabis is legal for some purpose, there are still typically regulations limiting its use and the manner in which it may be transported. For example, some states and localities have passed laws (known as "open container laws") against transporting, via motor vehicle, cannabis that is not contained in its original sealed packaging.

In addition, to preserve the useful life of cannabis, it is ideal that the substance be contained in an environment having a certain relative humidity. Typically, cannabis is best maintained at a relative humidity of 60%-65%. However, for some applications, a greater or lesser relative humidity may be appropriate.

There is thus a need for a cannabis container that maintains a desired relative humidity, which is simple to manufacture and optionally provides a tamper evident feature that helps facilitate open-container compliant possession and transport of cannabis.

BRIEF SUMMARY OF THE INVENTION

Accordingly, in one aspect, the invention is directed to a method for storing and preserving cannabis or cannabis-containing substances (or potentially other items, e.g., tobacco, requiring a predetermined relative humidity for preserving useful product life). The method includes providing a container assembly and storing the cannabis or cannabis-containing substance(s) therein. The assembly includes a lid and a container body, wherein the lid is configured to be closed onto the container body over an opening of the container body. The opening provides access to an interior space having a product compartment adapted to store product. The assembly also includes a humectant compartment permanently secured within the assembly (as opposed to loosely disposed within, e.g., in the form of a rigid canister or flexible sachet). The humectant compartment includes a rigid housing containing a humectant solution. The rigid housing is configured within the assembly to prevent leaking of the humectant solution into the product compartment while facilitating bidirectional transmission of moisture between the humectant compartment and the product compartment. The humectant solution regulates relative humidity of the product compartment to maintain the relative humidity at a predetermined level.

In another aspect, the invention is directed to methods of making container assemblies. According to one optional method, a container body and a lid configured to be closed onto the container body over an opening of the container body, are provided. The opening provides access to an interior space having a product compartment adapted to store product. The method further includes providing a humectant compartment that is permanently secured within the body or the lid, the humectant compartment including a rigid housing. While the lid is in an open position or not secured to the container body, a pre-determined volume of humectant solution is fed, in a filling process, into the rigid housing. The rigid housing is optionally closed with a rigid housing cover interfacing with the rigid housing with a mechanical tolerance that provides liquid impermeability and moisture permeability and/or a housing cover that is liquid impermeable and moisture permeable. Additional methods of making container assemblies according to the invention are disclosed and contemplated.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF PREFERRED EMBODIMENTS OF THE INVENTION

Figure 2:
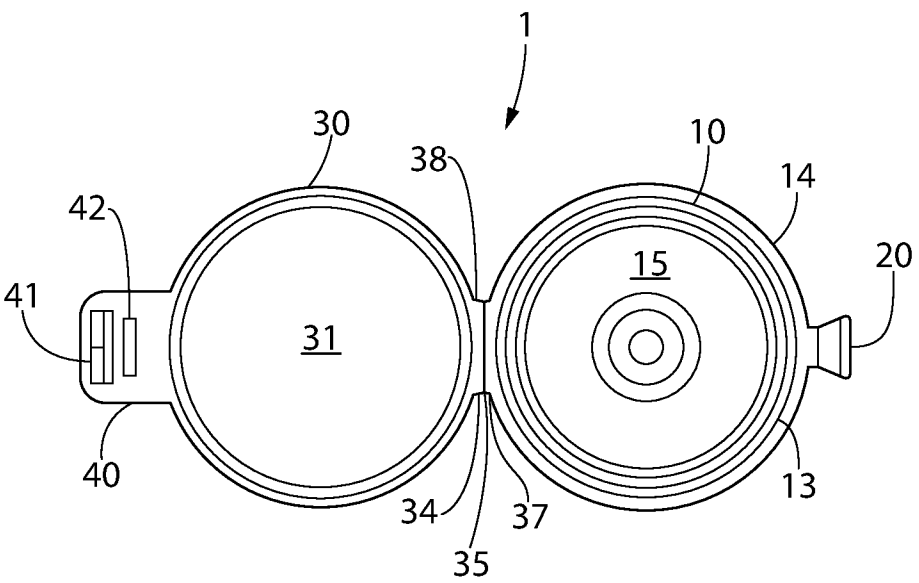
FIG. 2 shows an overhead plan view of the assembly of FIG. 1.
Figure 1:
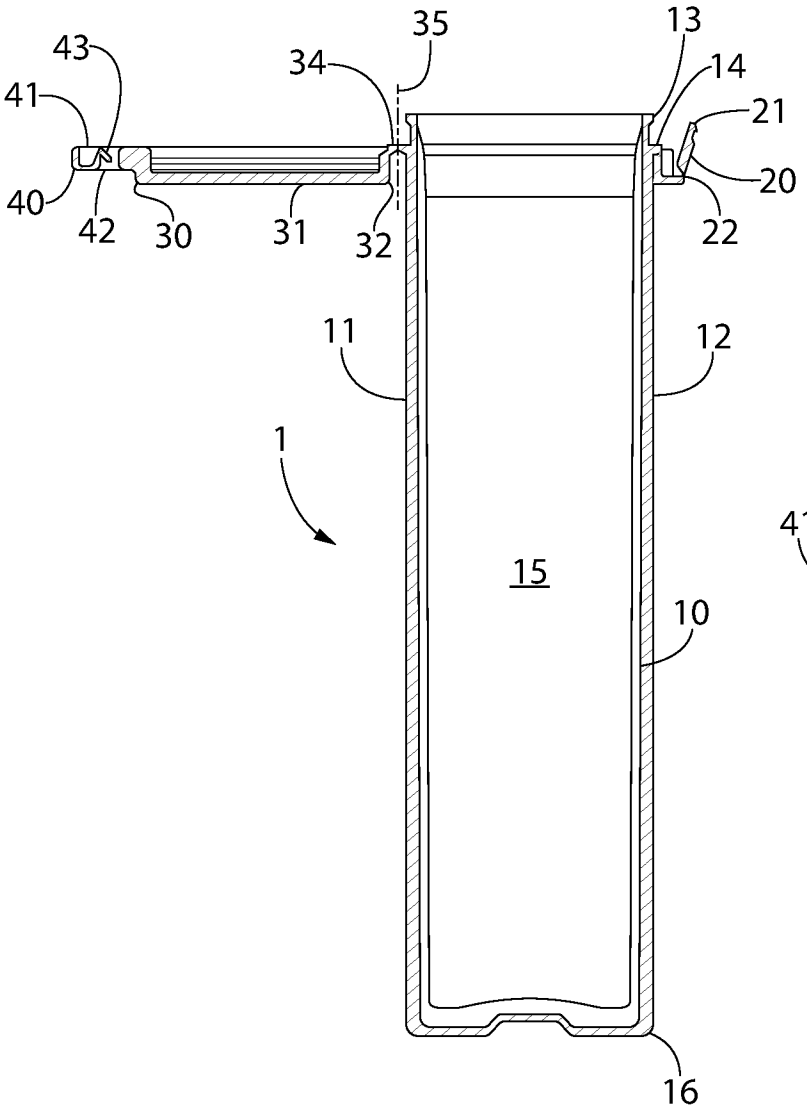
FIG. 1 shows a sectional view of an embodiment of a container and lid assembly having a tamper evident feature according to an aspect of the invention.

One optional aspect of the invention is a tamper evident feature or mechanism, which provides a visual indication as to whether or not a container according to the invention has been opened after initial filling of contents. An exemplary embodiment of such a tamper evident feature is described in U.S. Pat. No. 6,398,067, which is incorporated by reference herein in its entirety.

A tamper evident feature, substantially as described in U.S. Pat. No. 6,398,067, or in alternative embodiments, should provide a visual indication that: (a) when not broken, the container's lid has not been opened post initial filling of contents; and (b) when broken, the container lid has been opened post initial filling of contents thus providing a visual indicator that the container was tampered with. Tamper evident features that may be used in accordance with the invention, may provide a breakable structure securing the lid in a closed position on the container body. If the breakable structure is broken or has its structural integrity otherwise compromised, that serves as visually confirmable evidence that the container has been tampered with.

Referring now in detail to the various figures of the drawings wherein like reference numerals refer to like parts, there are shown in FIGS. 1-4 various views of a tamper evident feature or mechanism on a tamper evident container and lid assembly 1 according to an optional embodiment of the present invention. The assembly 1 comprises a container 10 having a base 16, an internal cavity 15, an outer surface 12 and an upper portion 11. The container 10 has a rim 13 at the upper portion 11. The container 10 also has a flange 14 extending radially outwardly from the outer surface 12 of the container 10. A detachable protrusion 20 with a contact element 21 and a break point 22 is located at or near flange 14. The assembly 1 also includes a lid 30 having a base 31. The lid 30 also has a tab 40 and a hinge 34. The tab 40 has a first and second slot 41 and 42 respectively, capable of housing the protrusion 20. The second slot 42 comprises an interlocking device 43.

The hinge 34 is also attached at or near the container flange 14. In one embodiment, the hinge 34 has a recess 35 that functions as a bending point for ease of opening and closing of the container 10. Suitable material for assembly 10 includes plastic (e.g. thermoplastic, such as polypropylene and polyethylene). In an embodiment, the lid 30 and the container 10 may be integrally molded of the plastic to form a hinge 34 there-between. In another embodiment, the lid 30 and the container 10 may be produced in a molding process and, in still another embodiment, may be molded in accordance with the mold and/or using a molding process similar to those disclosed in U.S. Pat. Nos. 4,783,056 and 4,812,116 respectively, which are incorporated by reference in their entireties. In a further embodiment, the lid 30 and container 10 may be produced in accordance with U.S. Pat No. RE37,676, which is incorporated by reference herein in its entirety. In an optional embodiment, the lid and container are not integral and are assembled together, e.g. at or by the hinge 34.

FIG. 2 shows an overhead plan view of the assembly 10 in an opened position. The assembly 10 includes the container 10 and the lid 30 connected by the hinge 34. The container 10 has the cavity 15, the rim 13 and the flange 14. The lid 30 includes the circular base 31 and the tab 40. The tab 40 includes a first slot 41 and second slot 42. The hinge 34 has a recess 35 and two elements, 37 and 38 respectively. The first element 37 is attached to the flange 14 of the container 10 and second element 38 is attached to the lid 30.

Figure 3:
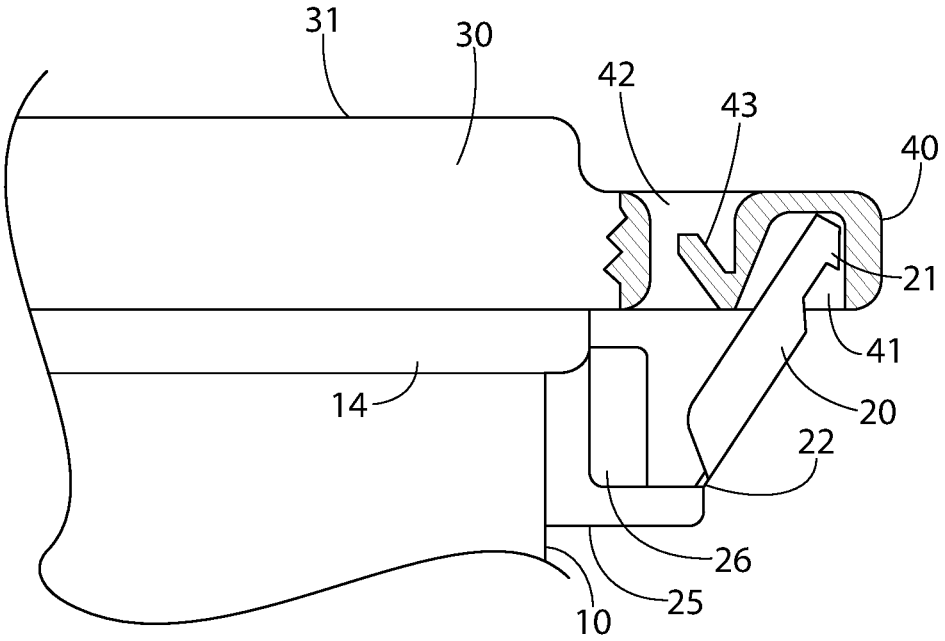
FIG. 3 shows a partial side elevation view of the tamper evident feature of FIG. 1 with the assembly in an empty stage, prior to filling.

FIG. 3 shows the container and lid assembly 1 in the empty stage prior to filling. The container 10 has a flange 14 which includes protrusion 20. The protrusion 20 optionally has a u-shaped element 25. The protrusion 20 has a contact element 21 and a break point 22. In the empty stage, the contact element 21 of the protrusion 20 is situated in the first slot 41 of the top 40 of the lid 30. It is understood that other designs of first slot 41 are contemplated. The only design requirement of first slot 41 is that it serves the purpose of holding protrusion 20 in place during handling and prior to the filling stage. As such, protrusion 20 is protected from accidentally being torn off prior to engaging protrusion 20 with interlocking device 43. There is a space between the protrusion 20 and the stop rib 26 and the second slot 42 with the interlocking device 43 remaining empty.

Figure 4:
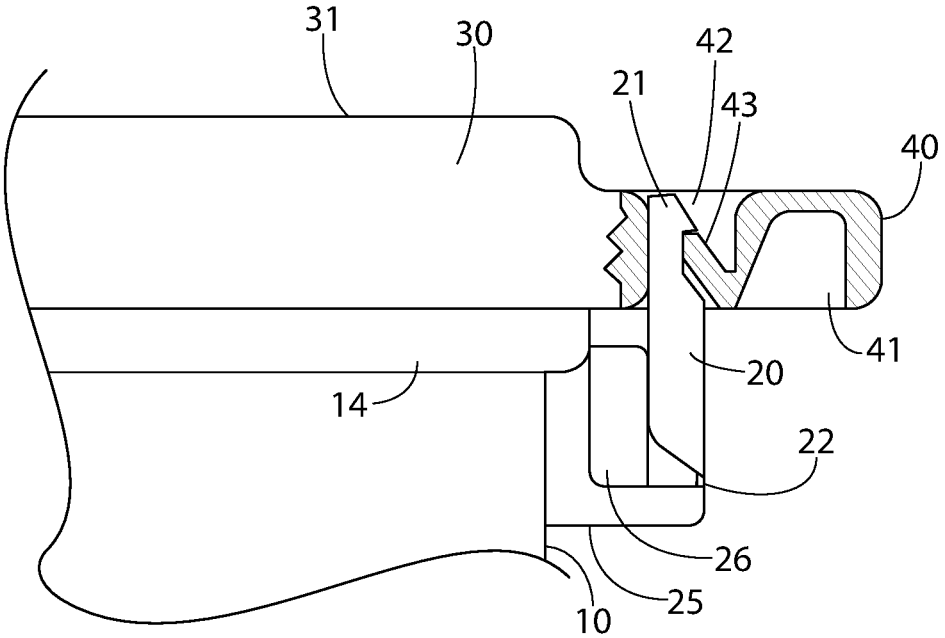
FIG. 4 shows a partial side elevation view of the tamper evident feature of FIG. 1 with the assembly in a filled stage.
Figure 5:
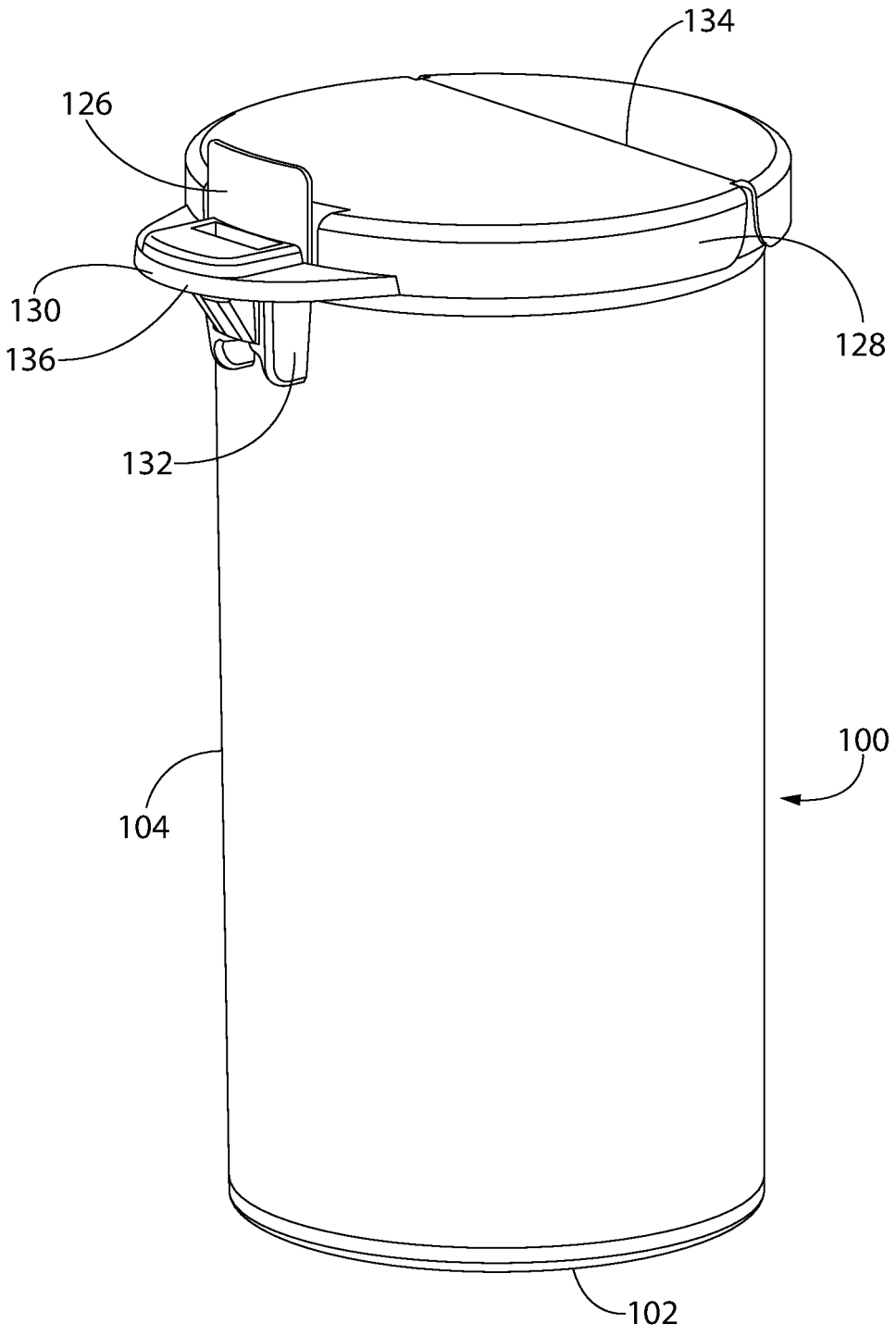
FIG. 5 shows a perspective view of a first embodiment of a humidity controlled lid and container assembly according to an aspect of the invention.
Figure 6:
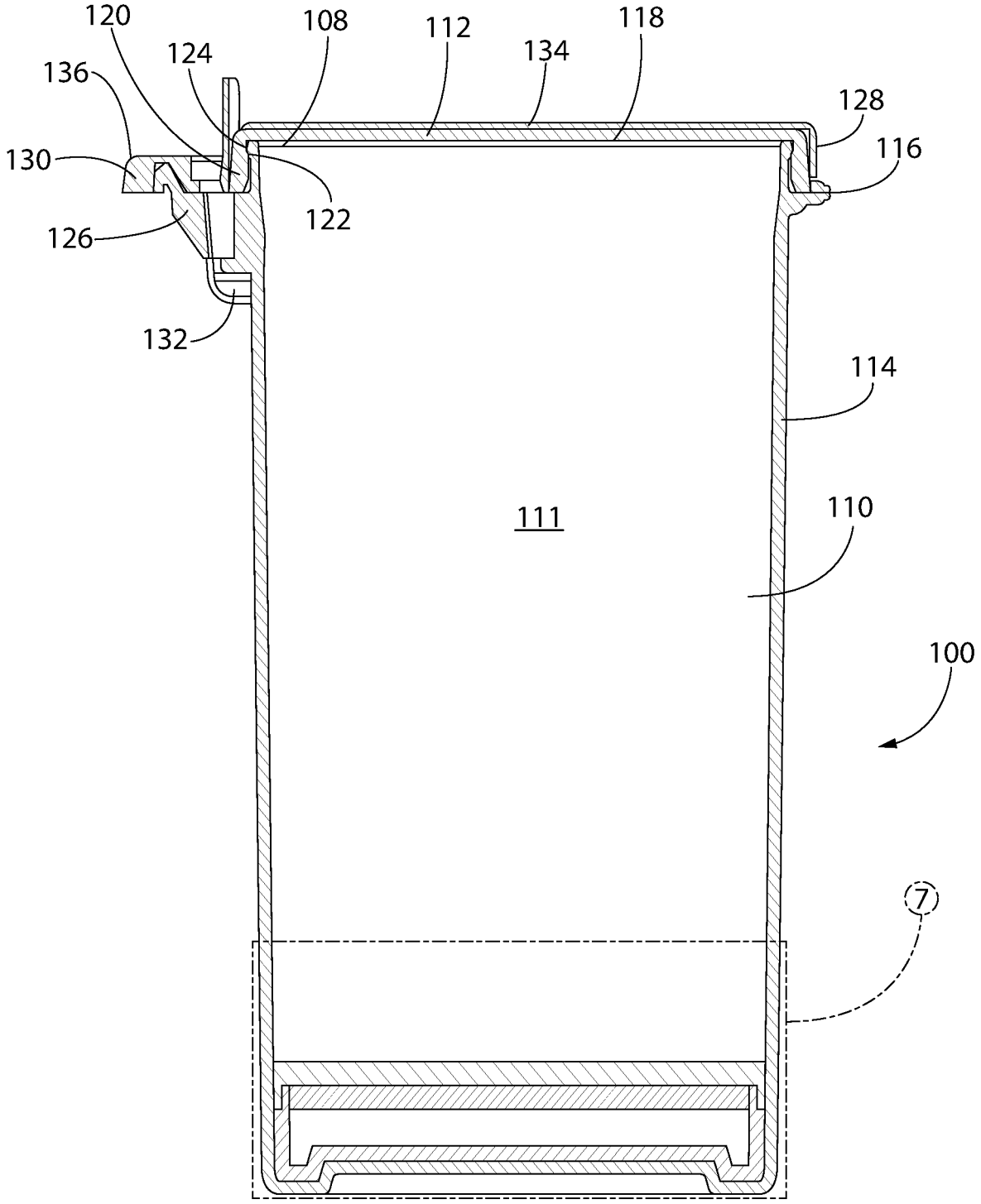
FIG. 6 shows a sectional view of the assembly of FIG. 5.
Figure 7:
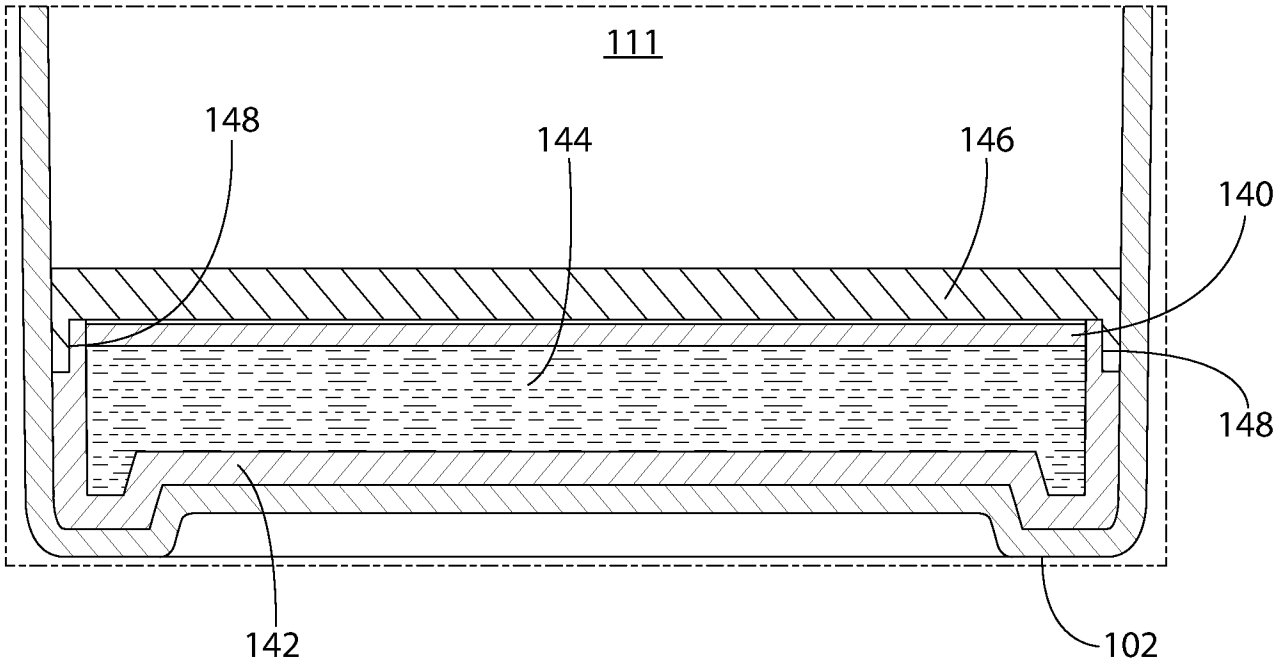
FIG. 7 shows an enlarged partial sectional view of a bottom section of the assembly of FIG. 5.
Figure 8:
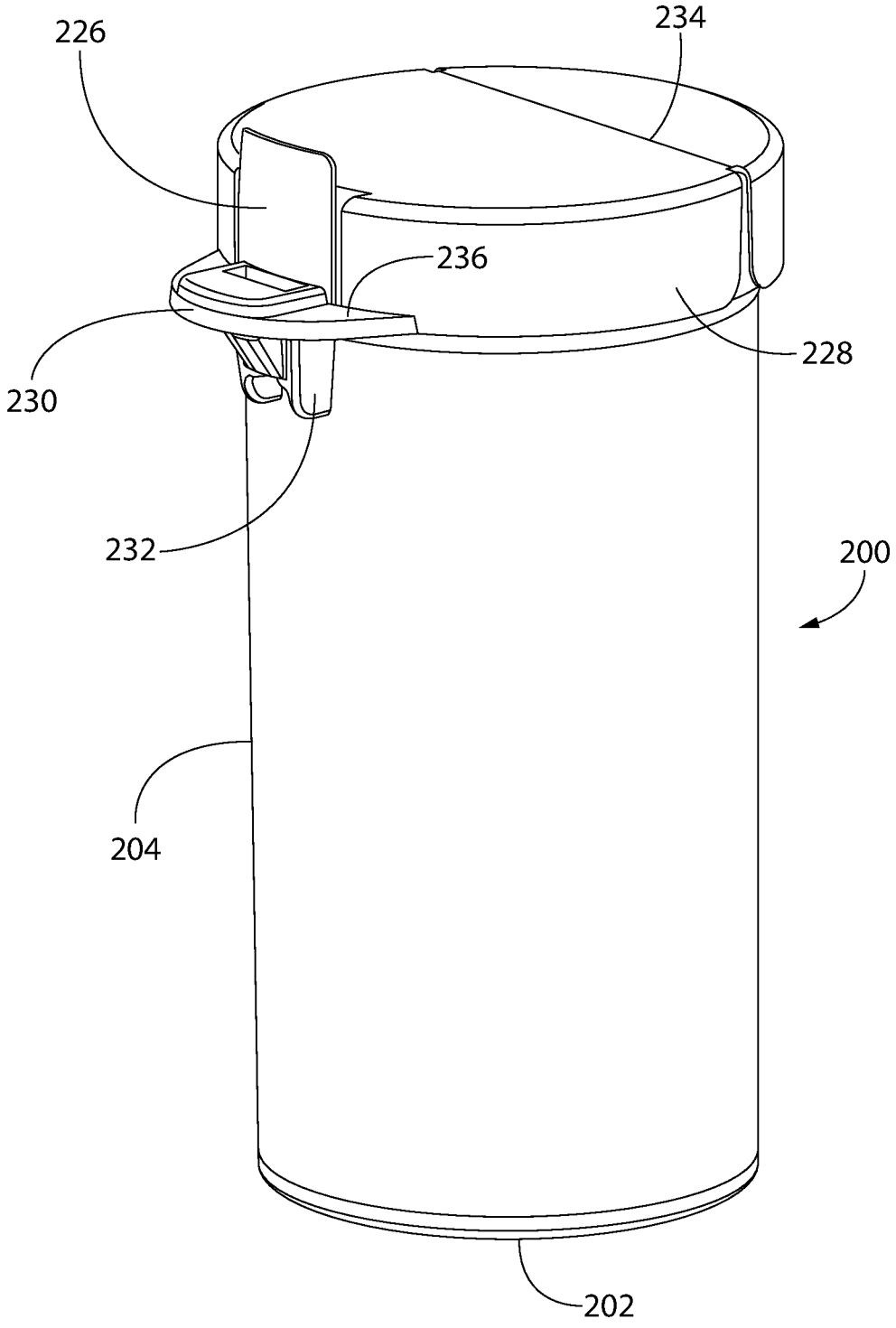
FIG. 8 shows a perspective view of a second embodiment of a humidity controlled lid and container assembly according to an aspect of the invention.
Figure 9:
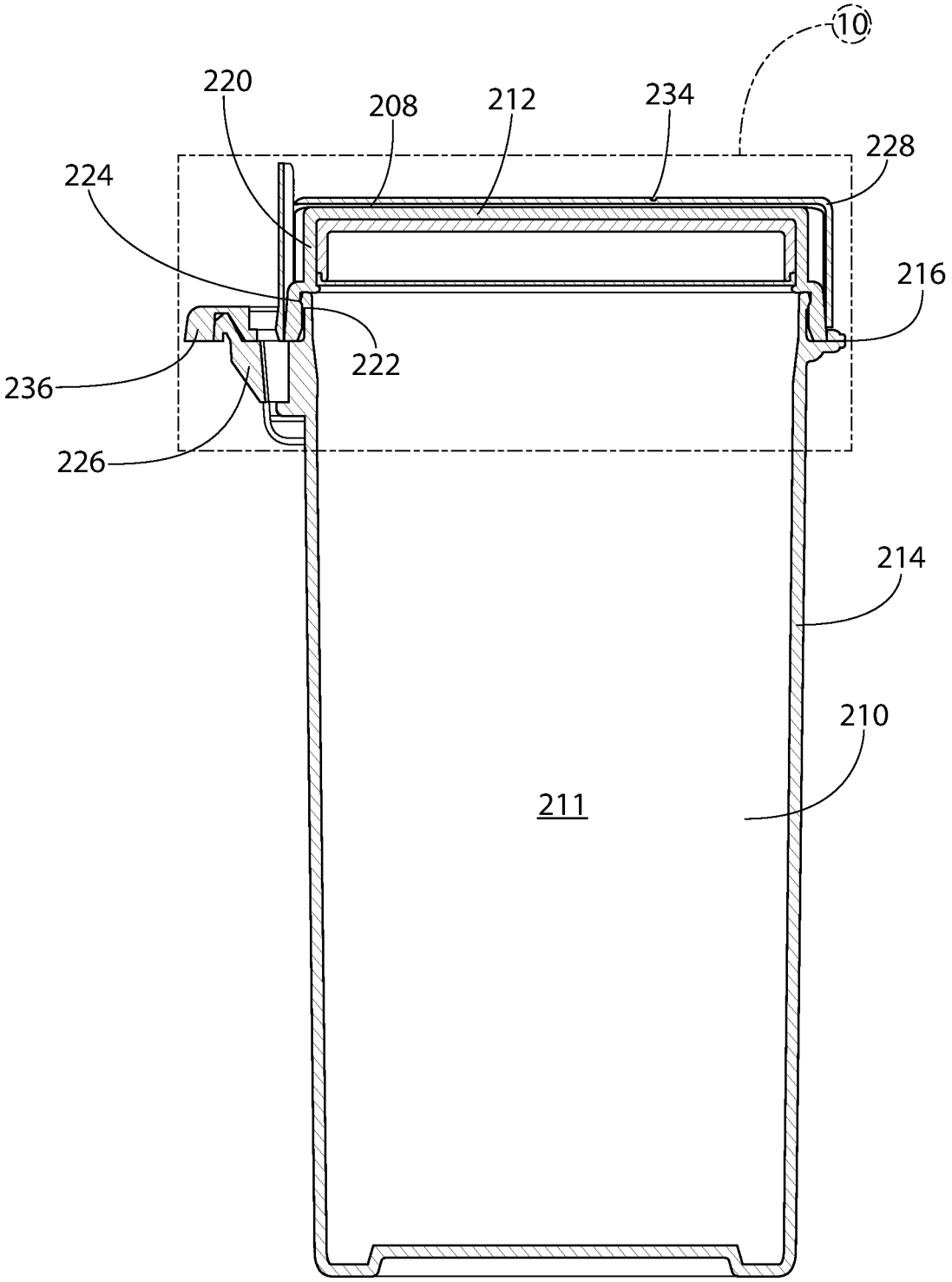
FIG. 9 shows a sectional view of the assembly of FIG. 8.
Figure 10:
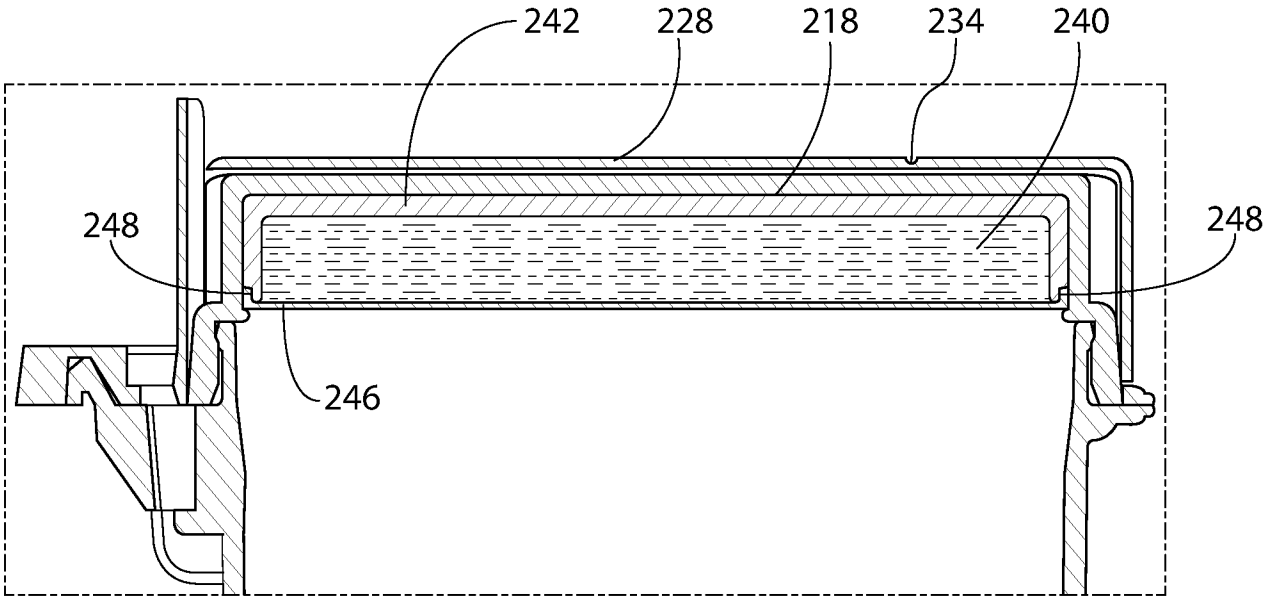
FIG. 10 shows an enlarged partial sectional view of a top section of the assembly of FIG. 8.
Figure 11:
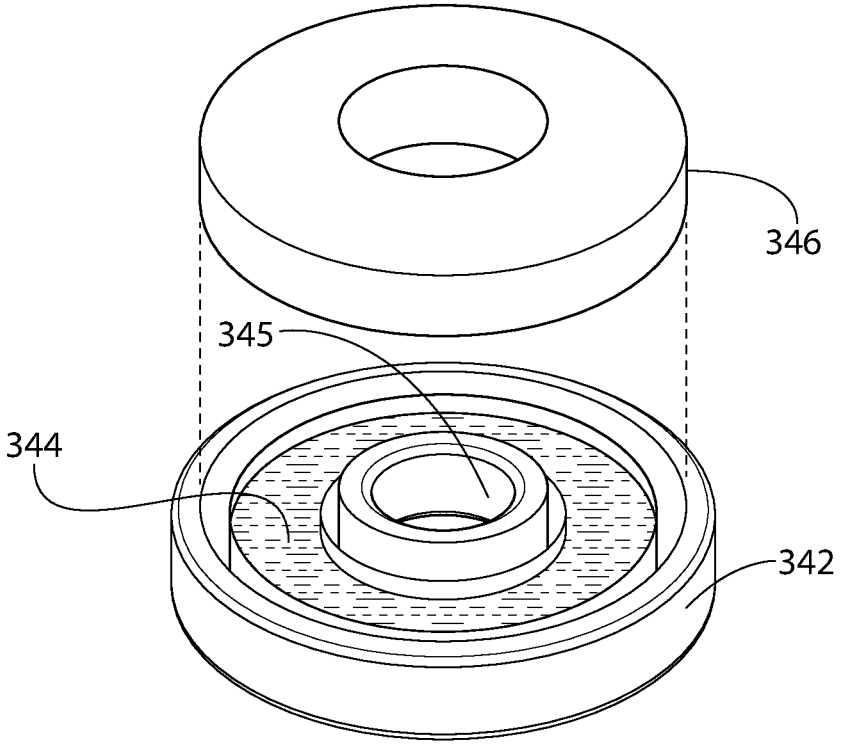
FIG. 11 shows an exploded perspective view of an optional humectant compartment that may be assembled into a container.
Figure 12:
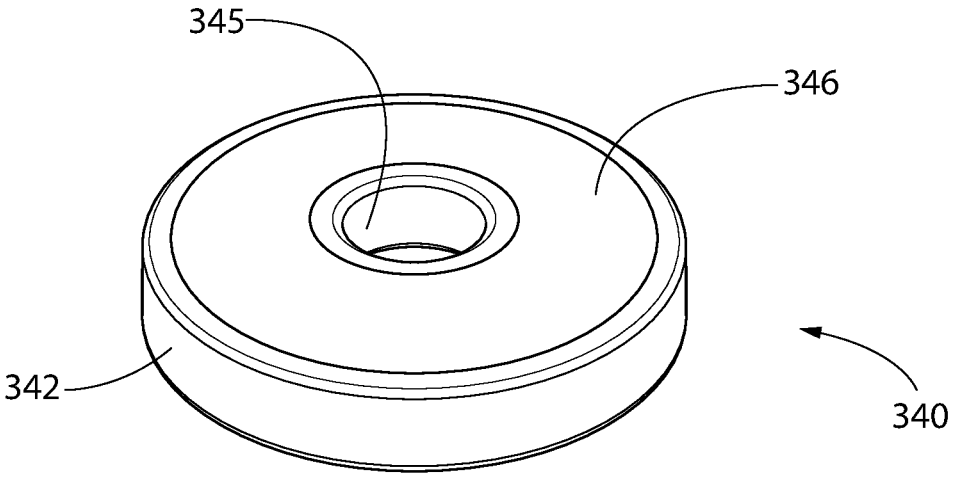
FIG. 12 shows the humectant compartment of FIG. 11 in assembled form.
Figure 13:
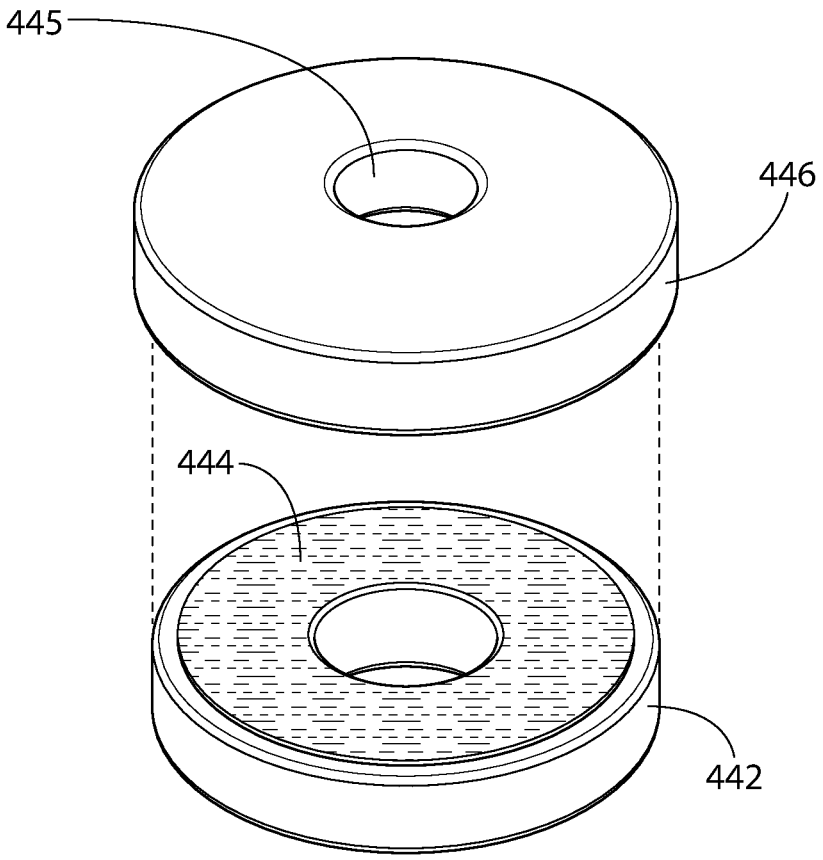
FIG. 13 shows an exploded perspective view of an alternative humectant compartment that may be assembled into a container.
Figure 14:
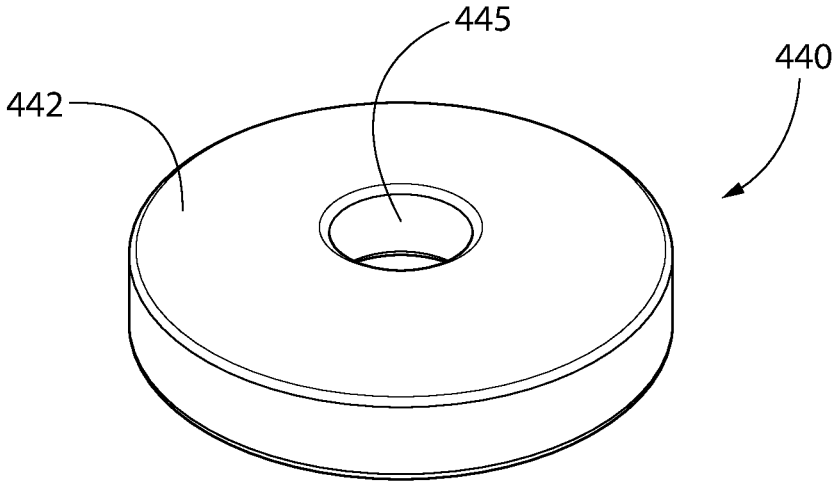
FIG. 14 shows the humectant compartment of FIG. 13 in assembled form.

FIG. 4 illustrates the container and lid assembly 1 in the filled stage. The lid 30 is placed upon the container 10 and the protrusion 20 is repositioned with the second slot 42. The contact element 21 of the protrusion 20 engages the interlocking device 43 of the second slot 42 of the tab 40 to form a tamper evident seal. The stop rib 26 restricts the movement of the protrusion 20.

Subsequently, a user would break the tamper evident seal by applying sufficient frontal upward force to allow the interlocking device 43 of the second slot 42 to engage the contact element 21 of the second slot 42 and to engage the contact element 21 of the protrusion 20 to detach the protrusion 20 from the flange 14 at the break point 22.

It is understood that the design of break point 22 is such that, when sufficient frontal upward force is applied to the lid to open the vial, the protrusion must fail (e.g. break) at break point 22 prior to any failure between the engagement of protrusion 20 with interlocking device 43. Consequently, in one embodiment, break point 22 width is sufficiently narrow to break when sufficient frontal upward force is applied to open the vial while, at the same time, is sufficiently flexible and of suitable design to allow for: (a) protrusion 20 to be moved from the first slot to the second slot without breakage; and (b) protrusion 20 to remain engaged with interlocking device 43 while sufficient force is applied to open the vial and break at break point 22.

Interlocking device 43 may be any design that is able to directly mate with protrusion 20 and remain engaged even when sufficient frontal force is applied to cause a break at break point 22. Such interlocking devices may include teeth, flexible projections and suitable wedge-like shapes.

The foregoing discussion regarding the interlocking device 43 describes an optional embodiment of a tamper evident mechanism that may be incorporated into a container assembly according to the present invention.

The present invention is not limited to flip-top vials. For example, a container assembly according to the invention may include a vial or other type of container having a fully removable lid without a hinge, such as screw-on, snap-on or stopper-type. However, the preferred embodiments, as disclosed herein and as illustrated in the accompanying drawing figures, are flip-top container assemblies, more particularly flip-top vials or vial assemblies. The different embodiments of vial assemblies (or more generically, container assemblies) according to the invention disclosed herein include distinguishing features. However, they also include certain generally common features between them ("common" as in the presence of such features, although they may differ in their details). These common features are now described simultaneously with reference to the different flip-top vial embodiments described herein. Distinguishing features of each of these embodiments will be explained, where necessary.

Referring now to FIGS. 5-10, there are shown embodiments of flip-top vial assemblies 100, 200 (or more generically, container assemblies), according to optional embodiments of the present invention. The vial assemblies 100, 200 may each respectively include a body 104, 204 having an opening 108, 208 leading to an interior space 110, 210, and a lid 112, 212. The interior space comprises a product compartment 111, 211 configured for storage of product.

The body 104, 204 has a generally tubular sidewall 114, 214 with a base 102, 202 axially spaced from the opening 108, 208. The body 104, 204 as shown in the figures is generally round, however other cross-sectional shapes are contemplated as well, e.g., elliptical.

A hinge 116, 216 may link the body 104, 204 and the lid 112, 212. The hinge 116, 216 can be configured to orient the lid 112, 212 to seat on the body 104, 204 when the lid 112, 212 and body 104, 204 are pivoted together. The lid 112, 212 comprises a base 118, 218 and a skirt 120, 220 extending from the base 118, 218. A lid sealing surface 122, 222 may be positioned around the periphery of the interior of the lid 112, 212. When the lid 112, 212 is seated on the body 104, 204 in a closed position, the lid sealing surface 122, 222 may be configured to mate with a complementary body sealing surface 124, 224 about the outer periphery of the body 104, 204, adjacent the opening 108, 208. Such mating configuration optionally forms a liquid tight or moisture tight seal, isolating the interior space 110, 210 from ambient conditions. However, as further described herein, applications for containers according to the invention may not require liquid tight or moisture tight features. In fact, for some applications, it may be preferred that moisture can travel freely between the ambient environment and the interior space 110, 210.

As used herein, the term "moisture-tight" is defined as having a moisture ingress (after three days) of less than 1500 micrograms of water, preferably less than about 750 micrograms of water, more preferably less than about 250 micrograms of water, determined by the following test method: (a) place one gram plus or minus 0.25 grams of molecular sieve in the container and record the weight; (b) fully close the container; (c) place the closed container in an environmental chamber at conditions of 80% relative humidity and 72° F.; (c) after one day, weigh the container containing the molecular sieve; (d) after four days, weigh the container containing the molecular sieve; and (e) subtract the first day sample from the fourth day sample to calculate the moisture ingress of the container in units of micrograms of water.

As used herein, the term "liquid tight" means that the container assembly, when closed and sealed, passes the blue crystal dye test. The blue crystal dye test is a visual test to detect leaks within a container seal. A container "passes" the blue crystal dye test if the white paper, in which the container is placed on, does not visually change color (i.e., the white paper does not become contaminated with the blue crystal dye liquid from the container). The blue crystal dye test procedure consists of the following: (a) the blue crystal dye liquid is prepared by adding one teaspoon of blue crystal dye powder to one gallon of alcohol and then thoroughly mixing the solution; (b) the blue crystal dye liquid is poured into the container (i.e., a sufficient amount of the dye liquid must be added so, when the container is placed upside down, the entire seal area must be covered); (c) the container is closed and sealed; (d) the container is placed upside down (i.e., inverted) on the white paper at room temperature; and (e) after 30 minutes, the white paper is inspected to determine if the white paper is contaminated with the blue crystal dye liquid.

A tamper evident mechanism 126, 226 is optionally provided on the assembly 100, 200 at an interface between the lid 112, 212 and the body 104, 204 to secure the lid 112, 212 in a closed position on the body 104, 204. The tamper evident mechanism 126, 226 may be substantially that described above and shown with respect to FIGS. 1 to 4. Optionally, the tamper evident mechanism 126, 226 is provided in part by a cover 128, 228 that envelops at least a portion of the lid 112, 212. In other words, the cover 128, 228 provides the tamper evident mechanism rather than the lid itself, e.g., as in the embodiments of FIGS. 1-4. The cover 128, 228 includes a cover extension 130, 230 and the body has a body extension 132, 232 extending outward from the sidewall 114, 214. The cover extension 130, 230 and body extension 132, 232 cooperate with each other, substantially as described above with respect to the tamper evident mechanism of FIGS. 1 to 4. Release of the body extension 132, 232 from the cover extension 130, 230 or the cover extension 130, 230 from the body extension 132, 232 irreversibly disengages the tamper evident mechanism 126, 226. Optionally, the cover 128, 228 includes a pivot axis 134, 234, enabling a user to lift the cover 128, 228 (once the tamper evident mechanism 126, 226 is disengaged), e.g., by a thumb tab 136, 236 provided on the cover 128, 228, to expose the lid 112, 212 for opening. If desired, the cover 128, 228 may be removed entirely once the tamper evident mechanism is broken, leaving only the lid 112, 212 to cover the opening 108, 208.

Optionally, the tamper evident mechanism comprises a breakable structure that secures the lid in the closed position, wherein breaking or otherwise disrupting the structural integrity of the breakable structure provides a visual indicator that the assembly has been tampered with. This feature is exemplified by the tamper evident mechanism 126, 226 shown, but may also be embodied in other forms. Optionally, the tamper evident mechanism is configured for initial setting in a first position wherein the lid is closed and secured onto the container body. The tamper evident mechanism may be releasable from the first position to release the lid, thus enabling the lid to be opened, wherein the tamper evident mechanism is configured to prevent retention in the first position after the tamper evident mechanism is released from the first position a single time. In other words, release of the tamper evident mechanism is irreversible. This feature is exemplified by the tamper evident mechanism 126, 226 shown, but may also be embodied in other forms.

As shown, the primary difference between the two assembly embodiments 100, 200 is as follows. The assembly 100 of FIGS. 5-7 includes a humectant compartment 140 permanently secured within the body 104, 204 (e.g., in the base 102), while the assembly 200 of FIGS. 8-10 includes a humectant compartment 240 permanently secured within the lid 212. For both embodiments, the humectant compartment 140, 240 is permanently secured within the assembly 100, 200 and comprises a rigid housing 142, 242 containing a liquid humectant solution 144, 244. The rigid housing 142, 242 may be a separate component or a rigid container assembled into the assembly 100, 200, or may be an integral portion of the assembly 100, 200 (wherein both alternatives fall within the rubric of "permanently secured" as used herein). The humectant solution 144, 244 is configured to regulate the relative humidity of the product containing compartment 111, 211 (e.g., to preserve product stored therein). For both embodiments, the humectant compartment 140, 240 further includes a housing cover 146, 246, which is optionally rigid, secured over the rigid housing 142, 242 to contain the humectant solution 144, 244 within the rigid housing 142, 242. The housing cover 146, 246 mates with the rigid housing 142, 242 at an interface 148, 248 between those components, wherein the interface 148, 248 is mechanically toleranced to provide liquid impermeability and bidirectional moisture permeability. Alternatively, or in addition to the aforementioned feature, a portion of the rigid housing 142, 242 and/or housing cover 146, 246 is liquid impermeable and bidirectionally moisture permeable. For example, the housing cover 146, 246 may comprise a membrane (optionally flexible) providing this functionality; however, at least the section of the housing cover 146, 246 at the interface 148, 248 is preferably rigid. Optionally, the housing cover 146, 246 is secured to the housing 142, 242 by a snap-fit configuration.

As used herein, providing liquid impermeability means that the relevant structure is leakproof, preventing liquid water or solution (e.g., humectant solution) from leaving the leakproof structure. As used herein, providing moisture permeability means that the relevant structure permits ingress and egress of water vapor sufficiently to allow the humectant solution contained within the structure to effectively regulate relative humidity of the product compartment of a container.

Figure 15:
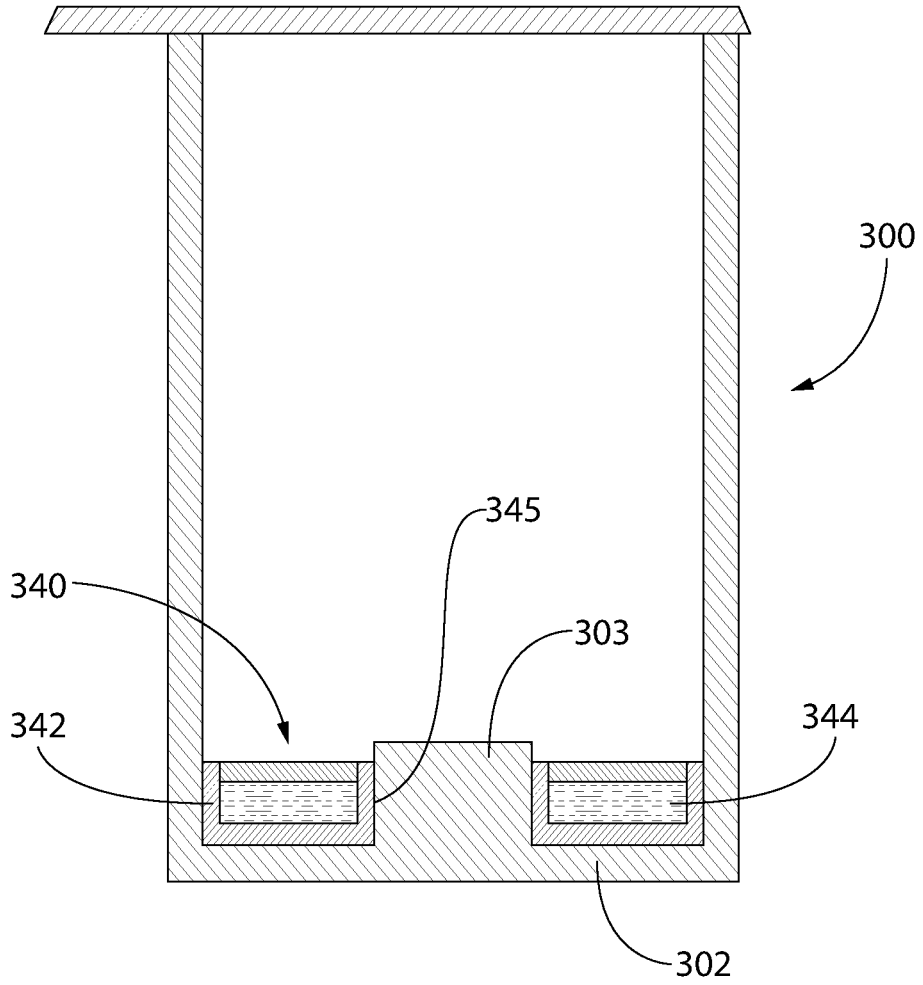
FIG. 15 shows the humectant compartment of FIGS. 11 and 12 assembled into a container.

Optionally, as discussed above, the humectant compartment 140, 240 may comprise a separate container assembled into the assembly 100, 200. Two such embodiments are shown in FIGS. 11-15. FIGS. 11-14 show a humectant compartment 340, 440 that is itself a separate rigid humectant filled container, configured to be assembled into another product storage container. The humectant compartment 340, 440 includes a rigid housing 342, 442 in which a predetermined volume of liquid humectant solution 344, 444 is filled. The humectant compartment 340, 440 further comprises a housing cover 346, 446 (optionally rigid) secured over the rigid housing 342, 442 to contain the humectant solution 344, 444 within the rigid housing 342, 442. The housing cover 346 of FIGS. 11 and 12 fits within the rigid housing 342 while the housing cover 446 of FIGS. 13 and 14 fits over and envelops at least a portion of the outer wall of the rigid housing 442. Either way, the housing cover 346, 446 mates with the rigid housing 342, 442 in such a way (e.g., via mechanical tolerances) as to provide liquid impermeability and bidirectional moisture permeability between the humectant 340, 440 and the ambient environment. The humectant compartment 340, 440 further includes an internal mating surface 345, 445, optionally providing a "doughnut shaped" configuration of the humectant compartment 340, 440 (although it should be understood that other shapes and configurations of the mating surface 345, 445 and the humectant compartment in general are contemplated). As shown in FIG. 15, the internal mating surface 345 is adapted to fixedly mate (e.g., via snap-fit or interference fit) with a complementary mating projection 303 of a container, optionally extending vertically from the base 302 of a container assembly 300.

In one aspect, the present invention relates to methods for making a container assembly. Container assemblies according to such methods may include, for example, the assemblies 100, 200 of FIGS. 5-10 and 15. Optionally, one method may include: (a) providing an opened container and lid as substantially herein described; (b) feeding a pre-determined volume of humectant solution, in a filling process, into the rigid housing of the humectant compartment; and (c) sealing the housing with a housing cover to render the housing liquid impermeable and bidirectionally moisture permeable.

Optionally, a method of making a container assembly such as the container assembly 300 of FIG. 15 may include: (a) providing an opened container and lid as substantially herein described; (b) feeding a pre-determined volume of humectant solution, in a filling process, into the rigid housing, e.g., 342, 442; (c) sealing the housing with a housing cover, e.g., 346, 446, to render the housing 342, 442 liquid impermeable and bidirectionally moisture permeable, thus creating a humectant compartment 340, 440; and (d) fixedly and permanently securing the assembled humectant compartment 340, 440 into a container.

Optionally, the predetermined level of relative humidity is from 60% to 65%. For example, optimal humidity conditions for cannabis is about 62% relative humidity. However, relative humidity of less than 60% and greater than 65% is also contemplated for different applications of the present invention. For example, some applications may require a relative humidity of from 50% to 60% while other applications may require a relative humidity of from 65% to 75%. Further, for tobacco or tobacco-containing substances, the desired relative humidity may vary. For example, cigars should typically be stored in environments of from 60% to 70% relative humidity and snuff typically from 50% to 60% relative humidity. On the other hand, it has been published that pipe tobacco should be maintained in environments of very low relative humidity (e.g., 10%-18%). In short, the desired predetermined level of relative humidity will depend on the nature of the product to be stored and preserved.

Optionally the saturated salt solution includes one or more thickening agents to increase viscosity of the saturated salt solution. Non-limiting examples of potentially appropriate thickening agents include hydroxyethylcellulose, xantham gum, alumina and fumed silica.

Suitable humectant solutions for cannabis and cannabis containing products, among others, may include the following: potassium carbonate ($K_2CO_32H_2O$); magnesium acetate ($Mg(C_2H_3O_2)_2.4H_2O$); sodium acetate ($NaC_2H_3O_2.3H_2O$), ammonium nitrate ($NH_4Cl$ or $NH_4NO_3$); or sodium bromide ($NaBr.2H_2O$).

Optionally, a child resistant feature may be provided on container assemblies according to the invention to impede a child's access to contents within the container.

In addition to storing and preserving cannabis or cannabis-containing substances, methods according to aspects of the present invention may include use of container assemblies disclosed herein to preserve and store other items requiring a predetermined relative humidity for preserving useful life of such items. Such items may include tobacco or tobacco-based substances or other plant-based items or substances.

While the invention has been described in detail and with reference to specific examples thereof, it will be apparent to one skilled in the art that various changes and modifications can be made therein without departing from the spirit and scope thereof. For example, while a primary use for containers according to the invention may be for storage of cannabis or cannabis-containing substances, it may be used for other substances requiring a specific relative humidity and tamper evident seal.

What is claimed is:

1. A method of storing and preserving a product, the method comprising:

a. providing a container assembly, the container assembly comprising:

i. a lid and a container body, wherein the lid is configured to be closed onto the container body over an opening of the container body, the opening providing access to an interior space comprising a product compartment configured to store a product, and the container body comprising a sidewall, and a base axially spaced from the opening; and ii. a humectant compartment permanently secured to the container body or lid within the container assembly, the humectant compartment comprising a rigid housing configured to contain a liquid humectant solution, and a housing cover secured over the rigid housing wherein the housing cover comprises a rigid portion;

b. feeding a predetermined volume of the liquid humectant solution in free-flowing form, through a filling process, into the rigid housing when the rigid housing is uncovered so that the rigid housing contains the predetermined volume of liquid humectant solution in free-flowing form and then sealing the rigid housing with the housing cover, wherein the liquid humectant solution itself is in direct contact with the rigid housing, and wherein the rigid housing and the housing cover are configured within the container assembly to prevent leaking of the liquid humectant solution into the product compartment while facilitating bidirectional transmission of moisture between the humectant compartment and the product compartment, wherein the liquid humectant solution regulates relative humidity of the product compartment to maintain the relative humidity from 60% to 65%; and c. storing the product in the product compartment, wherein the product is preserved by the method.

2. The method of claim 1, wherein the humectant compartment is permanently secured within the base of the container body.

3. The method of claim 1, wherein the humectant compartment is permanently secured within the lid.

4. The method of claim 1, wherein the lid is pivotally secured to the body by a hinge.

5. The method of claim 4, the container assembly further comprising a tamper evident mechanism at an interface between the lid and the container body, the tamper evident mechanism securing the lid in a closed position on the body, the tamper evident mechanism comprising a breakable structure that secures the lid in the closed position, wherein breaking or otherwise disrupting the structural integrity of the breakable structure provides a visual indicator that the assembly has been tampered with.

6. The method of claim 5, the tamper evident mechanism being configured for initial setting in a first position wherein the lid is closed and secured onto the container body, the tamper evident mechanism being releasable from the first position to release the lid, thus enabling the lid to be opened, wherein the tamper evident mechanism is configured to prevent retention in the first position after the tamper evident mechanism is released from the first position a single time.

7. The method of claim 5, the container assembly further comprising a cover that envelops at least a portion of the lid, the cover having a cover extension and the container body having a body extension, wherein the cover extension and body extension cooperate with each other to form the tamper evident mechanism, wherein release of the body extension from the cover extension or the cover extension from the body extension irreversibly disengages the tamper evident mechanism.

8. The method of claim 1, wherein the liquid humectant solution comprises a saturated salt solution.

9. The method of claim 8, wherein the saturated salt solution comprises one or more members selected from the group consisting of: lithium chloride, magnesium nitrate, sodium hydroxide, sodium sulfate decahydrate, potassium carbonate, magnesium acetate, sodium acetate, ammonium nitrate and sodium bromide.

10. The method of claim 8, wherein the saturated salt solution includes one or more thickening agents to increase viscosity of the saturated salt solution.

11. The method of claim 10, wherein the one or more thickening agents are selected from the group consisting of: hydroxyethylcellulose, xantham gum, alumina and fumed silica.

12. The method of claim 1, wherein the humectant compartment:

is assembled to have a mechanical tolerance that provides liquid impermeability and moisture permeability; and/or comprises at least a portion that is liquid impermeable and moisture permeable.

13. The method of claim 1, wherein the housing cover mates with the rigid housing at an interface that is mechanically toleranced to provide liquid impermeability and bidirectional permeability between the humectant compartment and the product compartment.

14. The method of claim 1, wherein the housing cover mates with the rigid housing by a snap-fit configuration.

15. The method of claim 1 wherein in the product is selected from cannabis, cannabis containing substance or tobacco.

16. A method of making a container assembly for storing and preserving cannabis or a cannabis-containing substance, the method comprising the steps of:

providing a container body and a lid configured to be closed onto the container body over an opening of the container body, the opening providing access to an interior space comprising a product compartment adapted to store a product, and the container body comprising a sidewall, and a base axially spaced from the opening;

providing a humectant compartment that is permanently secured within the container body or the lid, the humectant compartment comprising a rigid housing and a housing cover secured over the rigid housing wherein the housing cover comprises a rigid portion;

while the lid is in an open position or not secured to the container body, feeding a predetermined volume of a liquid humectant solution, in a filling process, into the rigid housing in free-flowing form when the rigid housing is uncovered, wherein the predetermined volume of liquid humectant solution in free-flowing form itself is in direct contact with the rigid housing; and closing the rigid housing with:

the housing cover interfacing with the rigid housing with a mechanical tolerance that provides liquid impermeability and moisture permeability, wherein the liquid humectant solution provides from 60% to 65% relative humidity in the product compartment while the lid is in a closed position.

17. A method of making a liquid tight container assembly for storing and preserving cannabis or a cannabis-containing substance, the method comprising the steps of:

providing a container body and a lid configured to be closed onto the container body over an opening of the container body, the opening providing access to an interior space comprising a product compartment adapted to store the cannabis or the cannabis-containing substance, and the container body comprising a sidewall, and a base axially spaced from the opening;

providing a humectant compartment, initially separate from the container assembly, the humectant compartment comprising a rigid housing and a housing cover secured over the rigid housing wherein the housing cover comprises a rigid portion, feeding a predetermined volume of a liquid humectant solution in free-flowing form directly into the rigid housing when the rigid housing is uncovered and then sealing the rigid housing with the housing cover, wherein the predetermined volume of liquid humectant solution in free-flowing form itself is in direct contact with the rigid housing, the rigid housing comprising:

the housing cover interfacing with the rigid housing with a mechanical tolerance that provides liquid impermeability and moisture permeability, wherein the liquid humectant solution provides from 60% to 65% relative humidity in the product compartment while the lid is in a closed position.

18. The method of claim 17, wherein the lid is pivotally secured to the body by a hinge.

19. The method of claim 18, further comprising providing a tamper evident mechanism on the assembly configured to secure the lid in a closed position on the body.

20. The method of claim 17, wherein the humectant solution comprises a saturated salt solution, wherein the saturated salt solution comprises one or more members selected from the group consisting of: lithium chloride, magnesium nitrate, sodium hydroxide, sodium sulfate decahydrate, potassium carbonate, magnesium acetate, sodium acetate, ammonium nitrate and sodium bromide.

* * * * *